US010311837B1

(12) United States Patent
Zaret et al.

(10) Patent No.: US 10,311,837 B1
(45) Date of Patent: Jun. 4, 2019

(54) ENHANCED STRING INSTRUMENT

(71) Applicant: ZRM Sound, LLC, Mentor, OH (US)

(72) Inventors: Peter Harold Zaret, Mayfield Heights, OH (US); Dale K. Rodgers, Mentor, OH (US)

(73) Assignee: ZRM SOUND, LLC, Mentor, OH (US)

( * ) Notice: Subject to any disclaimer, the term of this patent is extended or adjusted under 35 U.S.C. 154(b) by 0 days.

(21) Appl. No.: 15/997,228

(22) Filed: Jun. 4, 2018

Related U.S. Application Data

(60) Provisional application No. 62/514,174, filed on Jun. 2, 2017.

(51) Int. Cl.
*G10D 3/02* (2006.01)
*G10D 3/06* (2006.01)
*G10D 1/08* (2006.01)

(52) U.S. Cl.
CPC ..... *G10D 3/02* (2013.01); *G10D 1/08* (2013.01); *G10D 3/06* (2013.01)

(58) Field of Classification Search
CPC ..... G10D 3/02; G10D 3/06; G10D 1/08
See application file for complete search history.

(56) References Cited

U.S. PATENT DOCUMENTS 70,991 A * 11/1867 Gemunder ..... G10D 3/02 84/294
3,383,970 A * 5/1968 Di Sibio ..... G10D 3/02 84/276
5,208,408 A * 5/1993 Cave ..... G10D 3/02 84/277
5,325,756 A * 7/1994 Sugden ..... G10D 3/02 84/276
5,381,714 A * 1/1995 Kasha ..... G10D 3/02 84/275
5,567,896 A * 10/1996 Gottschall ..... G10D 3/02 84/294
5,922,979 A * 7/1999 Yui ..... G10D 3/02 84/291
5,998,712 A * 12/1999 Schmidt ..... G10D 3/02 84/291
6,459,024 B1 * 10/2002 Baker ..... G10D 3/02 84/290
6,646,191 B1 * 11/2003 Martin ..... G10D 3/02 84/291
8,648,238 B1 * 2/2014 Trabits ..... G10D 3/04 84/298
8,872,009 B2 * 10/2014 Siwko ..... G10D 3/02 84/277
8,940,984 B2 * 1/2015 Davies ..... G10D 1/02 84/280
9,570,051 B1 * 2/2017 Moore ..... G10D 3/02
9,626,941 B1 * 4/2017 Moore ..... G10D 3/02

* cited by examiner

*Primary Examiner* — Robert W Horn
(74) *Attorney, Agent, or Firm* — Rankin, Hill & Clark LLP

(57) ABSTRACT

An acoustic musical string instrument, such as a guitar, and related methods include one or more of 1) slanted sound posts extending between the front sound board and a lateral brace on the back plate of the guitar; 2) longitudinal braces extending between a lateral brace and a side wall of the guitar, 3) longitudinal blocks extending between adjacent lateral braces of the guitar, between a lateral brace and the neck block, or between a lateral brace and the tail block; and 4) a metal covered bridge plate.

20 Claims, 4 Drawing Sheets

ENHANCED STRING INSTRUMENT

CROSS-REFERENCE TO RELATED APPLICATIONS

This application claims priority to U.S. Provisional Application 62/514,174, filed Jun. 2, 2017, which is incorporated herein by reference.

FIELD

The present subject matter relates to acoustic musical string instruments, such as guitars, having a hollow body, and improvements thereof.

BACKGROUND

Acoustic string instruments, such as guitars, conventionally have a hollow body including a sound hole, a neck, and strings that are stretched between the bridge on the body and a headstock on a neck, and over or near the sound hole. If expertly made from high-quality materials, guitars having this construction can have a rich, mellow sound, with volume evenly distributed across the frequency range of the strings. However, lower-cost instruments typically do not have high-quality materials and/or are not expertly made, and are thus affordable to the majority of buyers, such as most amateurs. These lower-cost instruments often have a weak sound that favors one end of the frequency spectrum (bass or treble) at the expense of the other. Accordingly, there is a need for an improved acoustic string instrument.

SUMMARY

The difficulties and drawbacks associated with previously known string instruments, means, and strategies are addressed in the present acoustic musical string instruments, and related combinations and methods.

In one embodiment, an acoustic musical string instrument includes a hollow body defining an interior, a tail end, and a neck end opposite from the tail end. The hollow body includes a sound board, a back plate, and a side wall extending between the sound board and the back plate. The sound board includes lateral braces arranged in the interior and contacting an interior surface of the back plate. A bridge plate is arrange on an interior surface of the sound board. Slanted sound posts are arranged in the interior. The slanted sound posts each define a first end and a second end distal from the first end. The first end contacts the sound board and the side wall, and the second end contacts the back plate and one of the lateral braces.

Preferably, the acoustic musical string instrument further includes longitudinal braces arranged in the interior, and each contacting adjacent lateral braces, or one of the lateral braces and the side wall.

In a preferred embodiment, the acoustic musical string instrument further includes longitudinal blocks arranged in the interior and on the back plate, and contacting two adjacent lateral braces, contacting one of the lateral braces and the neck block, or contacting one of the lateral braces and the tail block.

Preferably, the acoustic musical string instrument further includes a flat metal sheet arranged in the interior, such that a major surface of the flat metal sheet is mated to a flat interior surface of the bridge plate.

In another embodiment, a method of enhancing sound produced by a musical string instrument includes providing an acoustic musical string instrument. The string instrument includes a hollow body defining an interior, a tail end, and a neck end opposite from the tail end. The hollow body includes a sound board, a back plate, and a side wall extending between the sound board and the back plate. The sound board includes lateral braces arranged in the interior and contacting an interior surface of the back plate. A bridge plate is arrange on an interior surface of the sound board. The method includes providing slanted sound posts, each defining a first end and a second end distal from the first end. The method includes arranging the slanted sound posts in the interior such that for each of the slanted sound posts, the first end contacts the sound board and the side wall, and the second end contacts the back plate and one of the lateral braces.

Preferably, the method includes arranging longitudinal braces in the interior, such that the longitudinal braces each contact adjacent lateral braces or one of the lateral braces and the side wall.

In a preferred embodiment, the method includes arranging longitudinal blocks in the interior and on the back plate, such that two of the longitudinal blocks each contact two adjacent lateral braces, one of the longitudinal blocks contacts one of the lateral braces and the neck block, and another one of the longitudinal blocks contacts another one of the lateral braces and the tail block.

Preferably, the method includes arranging a flat metal sheet in the interior such that a major flat surface of the flat metal sheet is mated to a flat interior surface of the bridge plate.

As will be realized, the subject matter described herein is capable of other and different embodiments and its several details are capable of modifications in various respects, all without departing from the claimed subject matter. Accordingly, the drawings and description are to be regarded as illustrative and not restrictive.

BRIEF DESCRIPTION OF THE DRAWINGS

These, as well as other features, aspects, and advantages of the present subject matter, will be more completely understood and appreciated by referring to the following more detailed description of the exemplary embodiments of the present subject matter in conjunction with the accompanying drawings.

DETAILED DESCRIPTION OF THE EMBODIMENTS

Figure 1:
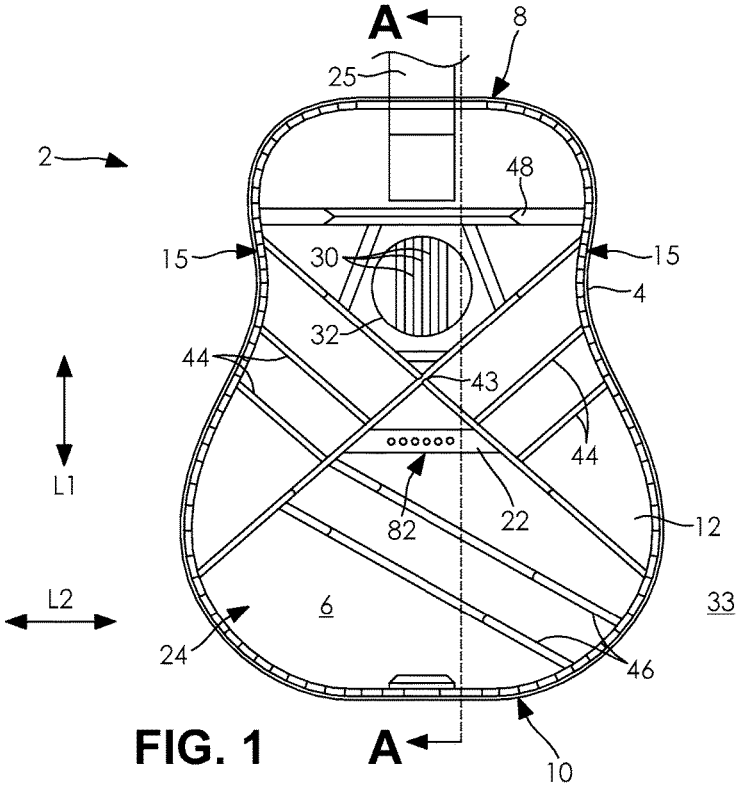
FIG. 1 is a plan view of half of a guitar according to an embodiment of the invention, and showing an interior portion including the sound board.

The present invention is a strategic configuration of features for an acoustic musical string instrument to produce a louder, deeper, richer, and more even sound at all frequencies (i.e. for all strings on the instrument).

Acoustic guitars or other acoustic musical string instruments in accordance with the present subject matter include one or more elements of 1) slanted sound posts, 2) longitudinal braces, 3) longitudinal blocks, and 4) a metal covered bridge plate. Including any one or more of these elements in a guitar or other acoustic musical string instrument can provided an improved (e.g. louder, deeper, richer, more even) sound over a similar acoustic musical string instrument not including any one or all of these elements.

The present subject matter will be discussed with respect to an acoustic guitar, as opposed to a classical acoustic guitar (which has a different structure), a violin, or other acoustic string instruments. However, it will be appreciated that the invention may be applicable to other acoustic musical string instruments including a classical acoustic guitar, ukulele, mandolin, violin, etc.

With reference to the accompanying FIGS. 1-7, an acoustic musical string instrument, for example an acoustic guitar 2, includes a hollow body 4 defining an interior 6, a neck end 8, and a tail end 10 opposite from the neck end 8. The hollow body 4 includes a sound board 12, a back plate 14, and a side wall 16 extending between the sound board 12 and the back plate 14. The guitar 2 includes a bridge 18 arranged on an exterior surface 20 of the sound board 12 and a bridge plate 22 arranged on an interior surface 24 of the sound board 12 opposite from the bridge plate 22. The guitar 2 includes a neck 26 on an exterior surface 28 of the hollow body 4 and extending from the neck end 8 away from the hollow body 4 in a longitudinal direction $L_1$, which runs between the neck end 8 and the tail end 10 of the guitar 2. The guitar can also include strings 30 stretched between the bridge 18 and the neck 26 (e.g. a headstock on the neck 26) that produce musical sounds/notes when vibrated. The interior 6 may provide a resonance chamber for the sound produced by strings 30.

The hollow body 4 can define one or more sound holes 32 through which sound produced by the strings 30 escapes from the interior 6 to an exterior 33 of the hollow body 4. As depicted, the sound hole 32 is arranged between the bridge 18 and the neck 26, although this is not required and the sound hole 32 can be arranged elsewhere, including on the side wall 16.

The back plate 14 may include one or more lateral braces arranged in the interior 6 and contacting the interior surface 42 of the back plate 14, and including a first lateral brace 34, a second lateral brace 36, a third lateral brace 38, and a fourth lateral brace 40. The lateral braces 34, 36, 38, 40 may extend in a lateral direction $L_2$, which runs perpendicular to the longitudinal direction $L_1$. The first lateral brace 34 is arranged closest to the neck end 8, the second lateral brace 36 is arranged closest to the tail end 10, the third lateral brace 38 is arranged between the first and second lateral braces 34, 36, and the fourth lateral brace 40 is arranged between the first and third lateral braces 34, 38 as depicted.

The sound board 12 may include a cross brace 43, side tone bars 44, tone bars 46, and a sound board lateral brace 48 arranged in the interior 6 and contacting the interior surface 24 of the sound board 12. In one aspect, the guitar 2 does not include the side tone bars 44. This allows the sound board 12 to be less stiff and thus vibrate more, thus increasing the bass and decreasing the treble emanating from the guitar 2.

The guitar 2 may include a tail block 50 arranged in the interior 6 and contacting an interior portion of the side wall 16 at the tail end 10, and a neck block 52 arranged in the interior 6 and contacting an interior portion of the side wall 16 at the neck end 8.

The guitar 2 can include one or more slanted sound posts arranged in the interior 6 of the hollow body 4. The slanted sound posts each define a first end and a second end distal from the first end. The first end contacts the sound board 12 at its edge where it meets the side wall 16, and may also contact the side wall 16, although this is not required. The second end contacts the back plate 14 near one of the lateral braces, and may also contact one of the lateral braces although this is not required. The slanted sound posts can include one or more of a first slanted sound post 54, a second slanted sound post 56, a third slanted sound post 58, a fourth slanted sound post 60, a fifth slanted sound post 62, and a sixth slanted sound post 64.

Figure 2:
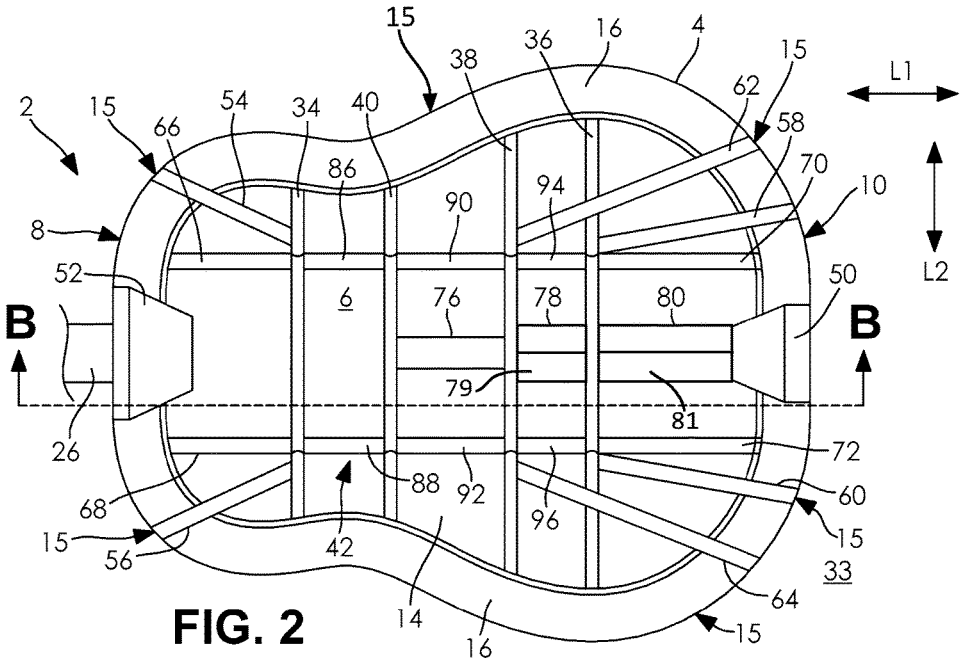
FIG. 2 is a plan view of the other half of the guitar of FIG. 1, and showing an interior portion including the back plate and side walls.

The first and second slanted sound posts 54, 56 may be identical, and can be arranged in a mirrored fashion in the interior 6 on opposite lateral sides of the guitar 2 as best depicted in FIG. 2. Likewise, the third and fourth slanted sound posts 58, 60 may be identical and similarly arranged in a mirrored fashion, as can the fifth and sixth slanted sound posts 62, 64.

The first and second slanted sound posts 54, 56 extend between the first lateral brace 34 and an interior junction 15 between the sound board 12 and the side wall 16 at the neck end 8. In this way, the first end of each of the first and second slanted sound posts 54, 56 contacts the first lateral brace 34 and the back plate 14, and the second end contacts the side wall 16 and the sound board 12.

The second and third slanted sound posts 58, 60 extend between the second lateral brace 36 and the interior junction 15 between the sound board 12 and the side wall 16 at the tail end 10. In this way, the first end of each of the second and third slanted sound posts 58, 60 contacts the second lateral brace 36 and the back plate 14, and the second end contacts the side wall 16 and the sound board 12.

The fifth and sixth slanted sound posts 62, 64 extend between the third lateral brace 38 and the interior junction 15 between the sound board 12 and the side wall 16 at the tail end 10. In this way, the first end of each of the fifth and sixth slanted sound posts 62, 64 contacts the third lateral brace 38 and the back plate 14, and the second end contacts the side wall 16 and the sound board 12.

The slanted sound posts 54, 56, 58, 60, 62, 64 can be glued or otherwise connected to the back plate 14 and optionally to the lateral braces and, and glued or otherwise connected to the sound board 12 near the interior corner junction 15 between the sound board 12 and the side wall 16, and optionally to the side wall 16. In one embodiment, the slanted sound posts 54, 5656, 58, 60, 62, 64 are wedged between the lateral braces and the back plate 14 and the interior corner junction 15 between the sound board 12 and the side wall 16

In one embodiment, the second end of the slanted sound posts 54, 56, 58, 60, 62, 64 do not contact the back plate 14, such that the slanted sound posts 54, 56, 58, 60, 62, 64 are connected directly to the lateral braces without contacting the back plate 14. In another embodiment, the slanted sound posts 54, 56, 58, 60, 62, 64 contact the back plate 14 and do not contact the lateral braces. In another embodiment, the slanted sound posts 54, 56, 58, 60, 62, 64 are connected directly to the interior surface 24 of the sound board 12 and do not contact the side wall 16. The slanted sound posts 54, 56, 58, 60, 62, 64 may be arranged such that they only contact an edge of the sound board 12 and do not contact a middle portion of the sound board 12. In this regard, the first end of the slanted sound posts 54, 56, 58, 60, 62, 64 may be connected to the sound board no more than 2.5 cm from the interior corner junction 15 between the sound board 12 and the side wall 16. The slanted sound post 54, 56, 58, 60, 62, 64 may be arranged so that their lengths are not perpendicular to one or more of the interior surface 24 of the sound board and the interior surface 42 of the back plate 14. In this arrangement, the slanted sound post 54, 56, 58, 60, 62, 64 do not dampen vibration of the sound board 12, yet can transfer vibration from the sound board 12 to the back plate 14.

It has been discovered that the strategic placement and configuration of the slanted sound posts 54, 56, 58, 60, 62, 64 transfers vibrations produced in the sound board 12 when the strings 30 are vibrated, from the sound board 12 to the back plate 14, which increases overall volume of sound projected from the guitar 2. Placement of the first end of the slanted sound posts 54, 56, 58, 60, 62, 64 in the interior corner junction 15 between the side wall 16 and the sound board 12 allows the transfer of vibration from the sound board 12 to the back plate 14 without inhibiting the vibration of the sound board 12, which is essential for producing quality musical sounds. The slanted sound posts 54, 56, 58, 60, 62, 64 are not particularly limited by the present subject matter, and can comprise various types of wood (for example a wood dowel rod), wood composite, or other material able to sufficiently transfer vibration from the sound board 12 to the back plate 14. Preferably, the slanted sound post 54, 56, 58, 60, 62, 64 each comprise or consist of a solid oak dowel. However, any materials of roughly the same density and weight could be used. Further, the shape of the slanted sound posts 54, 56, 58, 60, 62, 64 do not have to have a circular cross section, but could have other cross-sectional shapes such as square, rectangular, oval, triangle, or other shapes.

The guitar 2 can include one or more longitudinal braces arranged in the interior 6 and along the back plate 14, and contacting one of the lateral braces and the side wall 16, or contacting two adjacent lateral braces. In one embodiment, the longitudinal braces are arranged on the interior surface 42 of the back plate 14. The longitudinal braces can include one or more of a first longitudinal brace 66, a second longitudinal brace 68, a third longitudinal brace 70, a fourth longitudinal brace 72, fifth longitudinal brace 86, a sixth longitudinal brace 88, a seventh longitudinal brace 90, eighth longitudinal brace 92, a ninth longitudinal brace 94, and a tenth longitudinal brace 96.

The first and second longitudinal braces 66, 68 may be identical, and can be arranged in a mirrored fashion in the interior 6 on opposite lateral sides of the guitar 2 as best depicted in FIG. 2. Likewise, the other pairs of longitudinal braces 70 and 72, 86 and 88, 90 and 92, and 94 and 96 may be identical and similarly arranged in a mirrored fashion with respect to the other of the pair.

The first and second longitudinal braces 66, 68 each contact, and can be tightly wedged between, a portion of the side wall 16 at the neck end 8 and also the first lateral brace 34. The third and fourth longitudinal braces 70, 72 each contact, and can be tightly wedged between, a portion of the side wall 16 at the tail end 10 and also the second lateral brace 36. The fifth and sixth longitudinal braces 86, 88 each contact, and can be tightly wedge between, the first and fourth lateral braces 34, 40. The seventh and eighth longitudinal braces 90, 92 each contact, and can be tightly wedge between, the fourth and third lateral braces 40, 38. The ninth and tenth longitudinal braces 94, 96 each contact, and can be tightly wedge between, the third and second lateral braces 38, 36. The longitudinal braces 66, 68, 70, 72, 86, 88, 90, 92, 94, 96, 86, 88, 90, 92, 94, 96 may extend in the longitudinal direction $L_1$. Longitudinal braces 66, 86, 90, 94, 70 can be arranged in a straight or almost straight line with each other and between the neck end 8 and the tail end 10 of the guitar 2, and longitudinal braces 68, 88, 92, 96, 72 may also be arranged in a straight with each other or almost straight line between the neck end 8 and the tail end 10 of the guitar 2 as depicted in the figures. As such, the longitudinal braces are arranged in two rows extending in the longitudinal direction $L_1$ from the neck end 8 to the tail end 10.

The longitudinal braces 66, 68, 70, 72, 86, 88, 90, 92, 94, 96, like the slanted sound posts 54, 56, 58, 60, are not particularly limited by the present subject matter, and can comprise various types of wood (for example a wood dowel rod), wood composite, or other material. Preferably, the longitudinal braces 66, 68, 70, 72, 86, 88, 90, 92, 94, 96 each comprise or consist of a solid poplar dowel. However, and materials of roughly the same density and weight could be used. Further, the shape of the longitudinal braces 66, 68, 70, 72, 86, 88, 90, 92, 94, 96 do not have to have a circular cross section, but could have other cross-sectional shapes such as square or rectangular, oval, triangle, or other shapes. In another preferred embodiment, the longitudinal braces 66, 70, 86, 90, 94 are not individual pieces, but instead are made of a single unitary piece of material (e.g. wood) that contacts, and can be tightly wedged between, the side wall 16 at the neck end 8 and the side wall 16 at the tail end 10. In other words in this embodiment, the lateral braces 34, 36, 38, 40 do not dissect the single unitary piece of material making up the longitudinal braces 66, 70, 86, 90, 94 and the longitudinal braces 66, 70, 86, 90, 94 may not even contact the lateral braces 34, 36, 38, 40. Likewise, the longitudinal braces 68, 72, 88, 92, 96 can be a single unitary piece of material (e.g. wood) that contacts, and can be tightly wedged between, the side wall 16 at the neck end 8 and the side wall 16 at the tail end 10. Alternatively, the longitudinal braces 66, 68, 70, 72, 86, 88, 90, 92, 94, 96 and the lateral braces 34, 36, 38, 40 can be formed from a single unitary piece of material (e.g. wood) that is formed to have a web-like structure that has a similar configuration to the arrangement shown for the longitudinal braces and lateral braces.

The longitudinal braces 66, 68, 70, 72, 86, 88, 90, 92, 94, 96 can be glued or otherwise connected to the lateral braces on the back plate 14, and/or glued or otherwise connected to the side wall 16, and can optionally be glued to the back plate 14. In one embodiment the longitudinal braces 66, 68, 70, 72, 86, 88, 90, 92, 94, 96 are not glued to the back plate 14 of the guitar 2, and are only glued to the cross braces and/or to the side wall 16. In one embodiment, the longitudinal braces 66, 68, 70, 72, 86, 88, 90, 92, 94, 96 are wedged between the lateral braces and/or the side wall 16.

It has been discovered that the strategic placement and configuration of the longitudinal braces 66, 68, 70, 72, 86, 88, 90, 92, 94, 96 stiffen the back plate 14 of the guitar 2 and increase treble and especially the sustain of the sound projected by the guitar 2.

Figure 3:
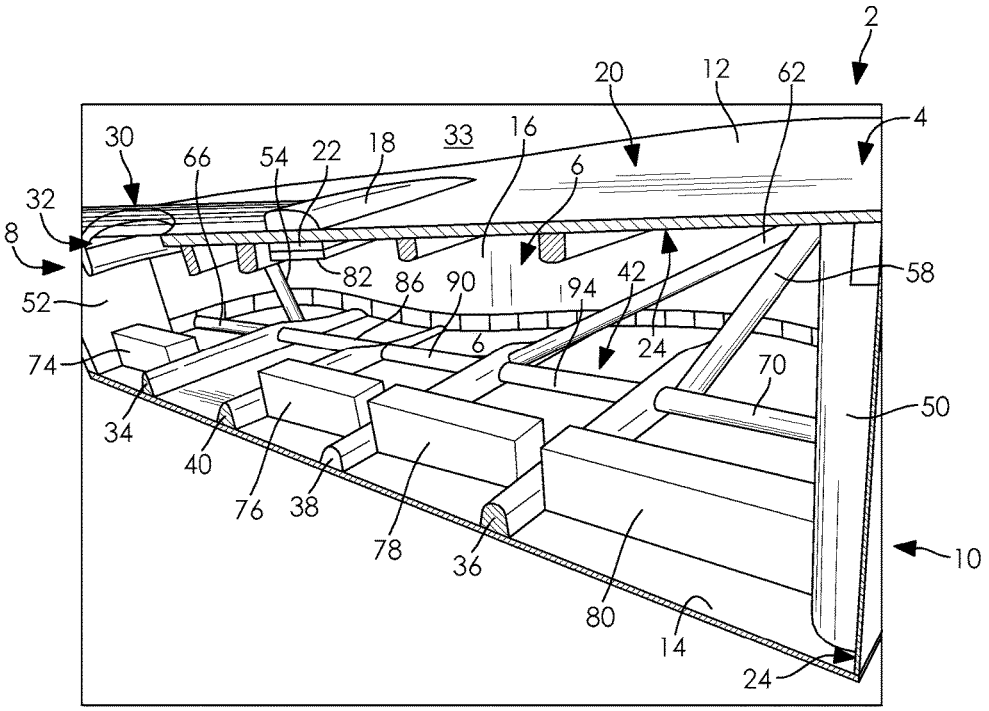
FIG. 3 is a sectional view of the guitar of FIG. 1 taken along line A-A in FIG. 1 and line B-B in FIG. 2.
Figure 4:
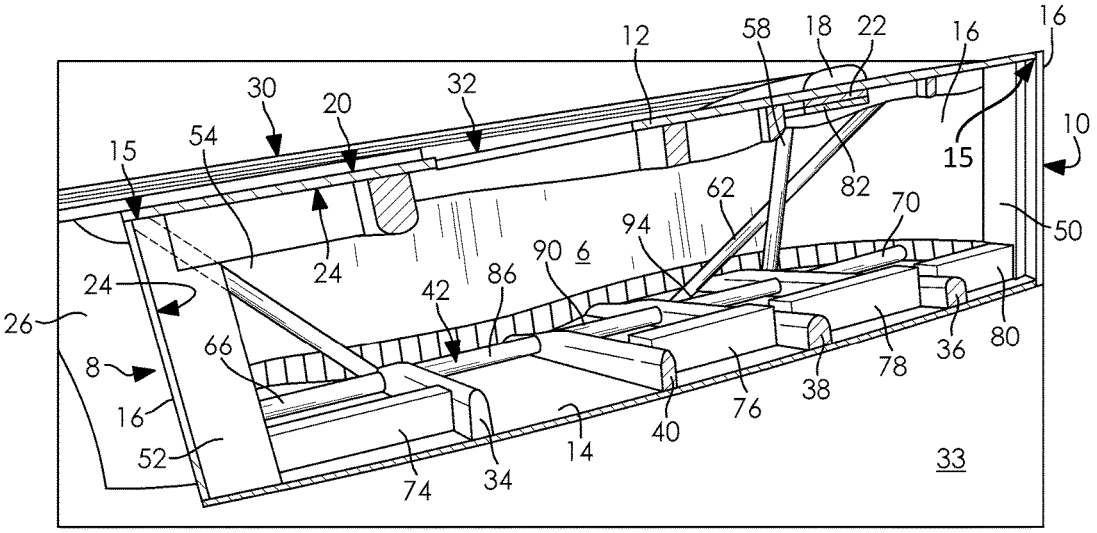
FIG. 4 is another sectional view of the guitar of FIG. 1 taken along line A-A in FIG. 1 and line B-B in FIG. 2.
Figure 5:
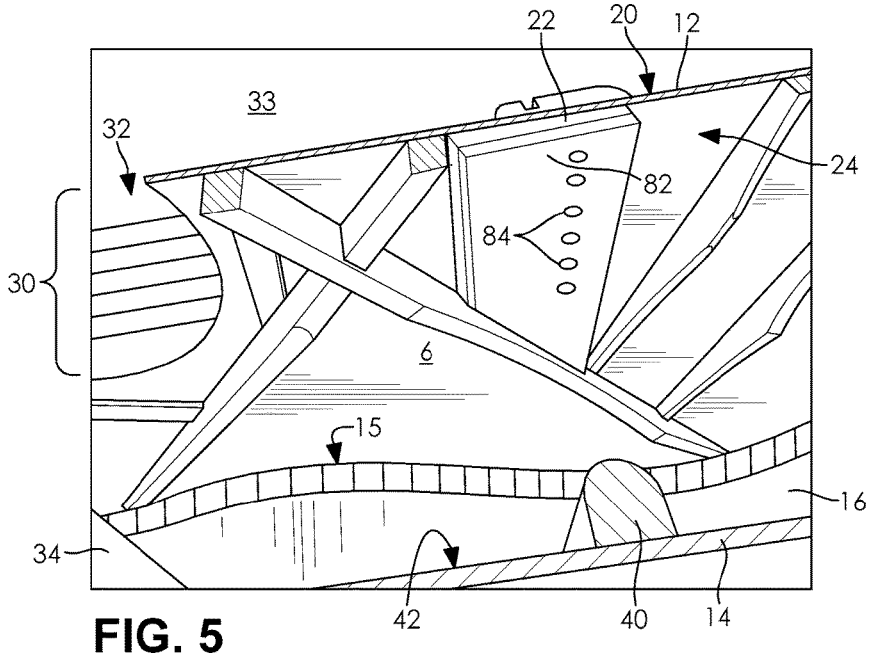
FIG. 5 is a detailed sectional view of the guitar of FIG. 1 taken along line A-A in FIG. 1 and line B-B in FIG. 2.
Figure 6:
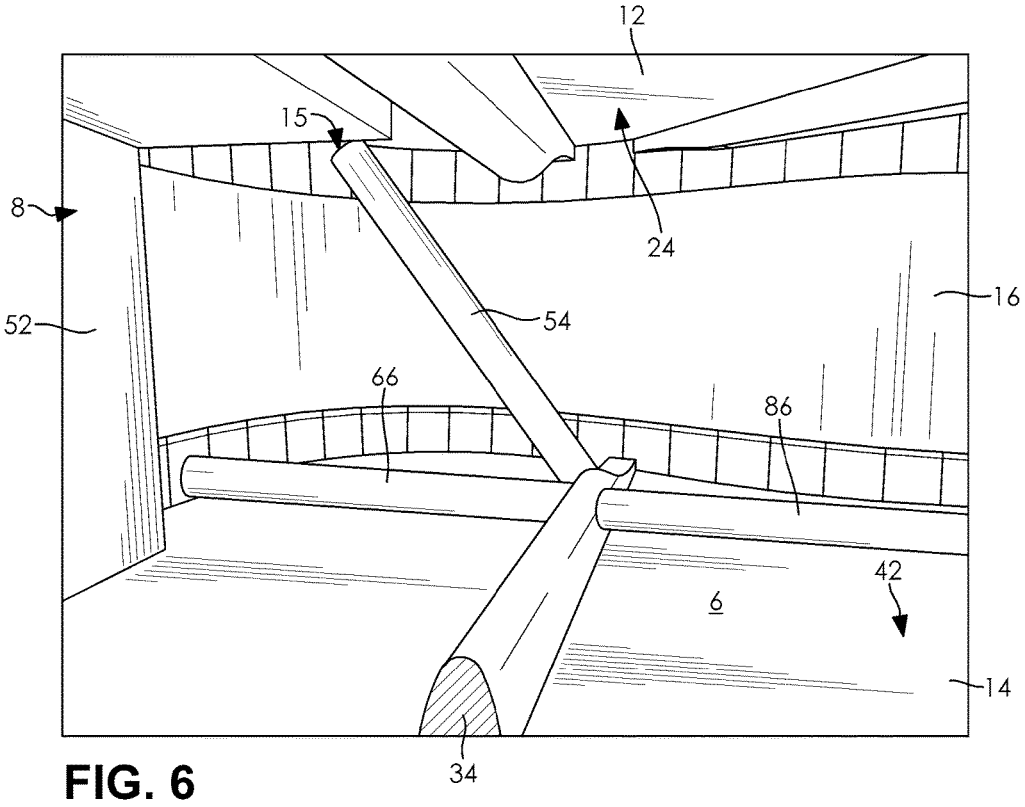
FIG. 6 is another detailed sectional view of the guitar of FIG. 1 taken along line A-A in FIG. 1 and line B-B in FIG. 2.
Figure 7:
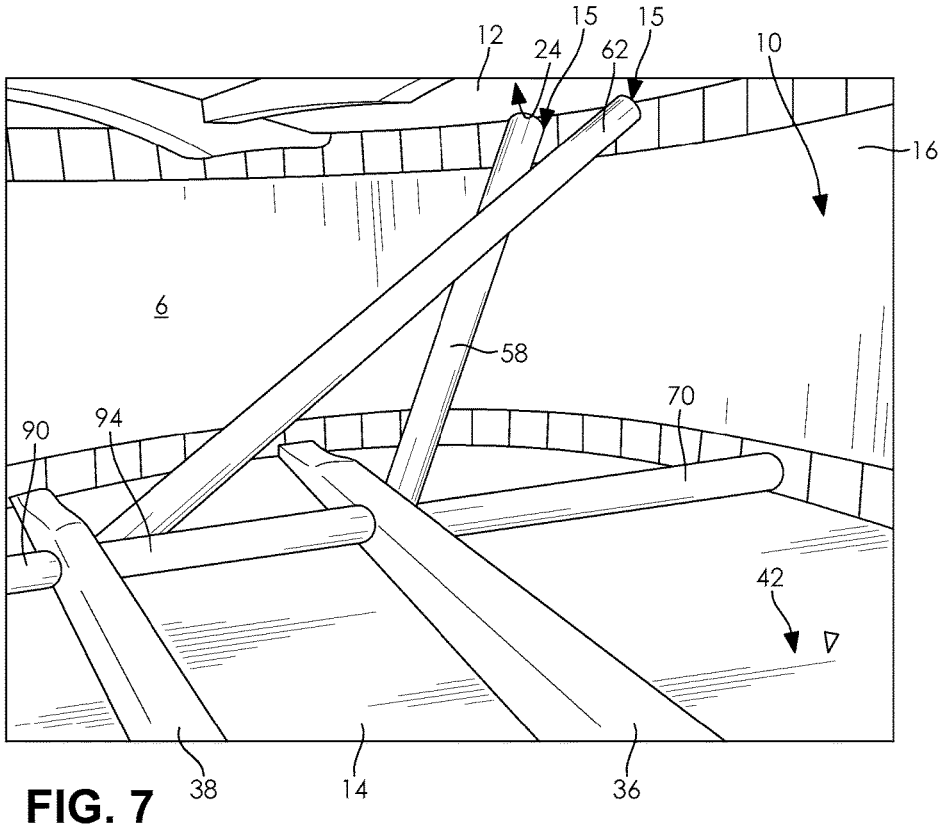
FIG. 7 is another detailed sectional view of the guitar of FIG. 1 taken along line A-A in FIG. 1 and line B-B in FIG. 2.

The guitar 2 can include one or more longitudinal blocks arranged in the interior 6 and along the back plate 14, and contacting two adjacent lateral braces, contacting one of the lateral braces and the neck block 52, or contacting one of the lateral braces and the tail block 50. In one embodiment, the longitudinal blocks are arranged on the back plate 14. In one embodiment as depicted in FIGS. 3-4, the longitudinal blocks can include a first longitudinal block 74, a second longitudinal block 76, a third longitudinal block 78, and a fourth longitudinal block 80. The first longitudinal block 74 may be arranged between and optionally contacting the first lateral brace 34 and the neck block 52. The second longitudinal block 76 may be arranged between and optionally contacting the third and fourth lateral braces 38, 40. The third longitudinal block 78 may be may be arranged between and optionally contacting the second and third lateral braces 36, 38. The fourth longitudinal block 80 may be may be arranged between and optionally contacting the second lateral brace 36 and the tail block 50. In another embodiment as depicted in FIG. 2, the longitudinal blocks can include the third longitudinal block 78, the fourth longitudinal block 80, a fifth longitudinal block 79, and a sixth longitudinal block 81. The third and fifth longitudinal blocks 78, 79 may be may be arranged between and optionally contacting the second and third lateral braces 36, 38. The fourth and sixth longitudinal blocks 80, 81 may be may be arranged between and optionally contacting the second lateral brace 36 and the tail block 50. In this embodiment, the first longitudinal block 74 shown in FIGS. 3-4 may be included. The invention includes different arrangements of longitudinal blocks.

The longitudinal blocks 74, 76, 78, 79, 80, 81 are not particularly limited by the present subject matter, and can comprise various types of wood (for example a wood block), wood composite, or other material. Preferably, the longitudinal blocks 74, 76, 78, 79, 80, 81 each comprise or consist of a solid maple block. However, any materials of roughly the same density and weight could be used. Further, the shape of the longitudinal blocks 74, 76, 78, 79, 80, 81 do not have to have a square or rectangular cross section as shown, but could have other cross-sectional shapes such as circular, oval, triangle, or other shapes.

The longitudinal blocks 74, 76, 78, 79, 80, 81 may extend in the longitudinal direction $L_1$. As shown, the longitudinal blocks 74, 76, 78, 79, 80, 81 are arranged down a center line of the guitar 2. However, it will be understood that the longitudinal blocks 74, 76, 78, 79, 80, 81 can be differently arranged, such as not in line with the center line of the guitar 2. The longitudinal blocks 74, 76, 78, 79, 80, 81 may be arranged in line with one another as shown in the figures. But this is not necessary, and the longitudinal blocks 74, 76, 78, 79, 80, 81 can instead be arranged in a non-linear configuration. Moreover, the guitar 2 can include more or less longitudinal blocks than depicted in the figures. For example, one or more additional longitudinal blocks can be arranged between and contacting the first and fourth lateral braces 34, 40.

In one embodiment, the longitudinal blocks 74, 76, 78, 79, 80, 81 are part of a single integral piece that extends from the neck block 52 to the tail block 50, and includes cutouts located at positions corresponding to the first, second, third, and fourth lateral braces 34, 36, 38, 40 to allow non-cutout portion of the integral piece to be arranged between and contacting the lateral braces 34, 36, 38, 40.

The longitudinal blocks 74, 76, 78, 79, 80, 81 can be glued or otherwise connected to the back plate 14, and can optionally be glued or otherwise connected to the lateral braces, the neck block 52, and tail block 50. In one embodiment the longitudinal blocks 74, 76, 78, 79, 80, 81 are glued only to the back plate 14 of the guitar 2, and are not glued to the lateral braces, the neck block 52 or the tail block 50. In one embodiment, the longitudinal blocks 74, 76, 78, 79, 80, 81 are wedged between the lateral braces and between the lateral braces and the neck block 52 and tail block 50.

It has been discovered that the strategic placement and configuration of the longitudinal blocks 74, 76, 78, 79, 80, 81 increases the mass of the back plate 14 and thereby increases the bass and sustain of the sound projected from the guitar 2.

The guitar 2 can include a metal covered bridge plate. The metal covered bridge plate can include a flat metal sheet 82 arranged in the interior 6, and contacting the bridge plate 22. As depicted in the figures, the flat metal sheet can be a plate having two major flat surfaces that are opposite of each other, with edges connecting the two major flat surfaces. The flat metal sheet 82 has one of the major flat surfaces mated to a flat interior surface of the bridge plate 22.

The flat metal sheet 82 may comprise metals, metal alloys, or metal composites. In one embodiment, the flat metal sheet 82 comprises aluminum, and is attached (e.g. glued) to the interior surface of the bridge plate 22. The metal sheet 82 is not particularly limited and can be made in any thickness as desired. In one aspect, the metal sheet 82 is made from a sheet of aluminum metal that is 1/16-1/4 inch thick, preferably about 1/8 inch thick. Softer or harder metals can be used. When softer metal is used, the sound projected by the guitar 2 is softer and more mellow. When harder metal is used, the sound has more treble. The metal sheet 82 can partially or completely cover the interior surface of the bridge plate 22. In one aspect, the metal sheet 82 includes holes 84 to allow strings 30 to be inserted therethrough.

It has been discovered that the strategic placement and configuration of the metal sheet 82 on the bridge plate 22 increases the treble of the sound projected from the guitar 2, and evens and balances the response between the strings 30.

If an adhesive or glue is used to connect or adhere elements 1-4 to various portions of the guitar 2, the adhesive or glue can comprise hide glue for example, however other adhesives can be used.

The present subject matter includes a method of enhancing sound produced by an acoustic musical string instrument, such as a guitar 2 as described herein. The method can include providing the slanted sound posts 54, 56, 58, 60, 62, 64, each defining a first end and a second end distal from the first end. The method can include arranging the slanted sound posts 54, 56, 58, 60, 62, 64 in the interior 6 such that for each of the slanted sound posts 54, 56, 58, 60, 62, 64, the first end contacts the sound board 12 near its junction 15 with the side wall 16, and optionally contacts the side wall 16, and the second end contacts the back plate 14 and optionally one of the lateral braces.

The method can include arranging the longitudinal braces 66, 68, 70, 72, 86, 88, 90, 92, 94, 96 in the interior 6, such that the longitudinal braces 66, 68, 70, 72, 86, 88, 90, 92, 94, 96 each are arranged on the interior surface 42 of the back plate 14 and contact adjacent lateral braces, or one of the lateral braces and the side wall 16. The method can comprise arranging the longitudinal blocks 74, 76, 78, 80 in the interior 6 and on the back plate 14, such that two of the longitudinal blocks 76, 78 each are arranged between two adjacent lateral braces 36, 38, 40, one of the longitudinal blocks 74 contacts one of the lateral braces 34 and the neck block 52, and another one of the longitudinal blocks 80 contacts another one of the lateral braces 36 and the tail block 50. The method can include arranging the flat metal sheet 82 in the interior 6 such that the major surface of the flat metal sheet 82 is mated to a flat interior surface of the bridge plate 22.

It has been found that the guitar 2 according to the present subject matter produces a sound that is louder, deeper, richer, clearer, and more even across the frequency range from bass to treble as compared to similar guitars without any one or all of elements 1-4.

Although specific embodiments of the invention have been illustrated, this does not preclude their application of elements 1-4 to acoustic musical stringed instruments other than acoustic guitars, such as classical guitars, mandolins, ukuleles, violins, etc.

Many other benefits will no doubt become apparent from future application and development of this technology.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scopes of the claimed subject matter, as expressed in the appended claims.

What is claimed is:

1. An musical string instrument comprising:

a hollow body defining an interior, a tail end, and a neck end opposite from the tail end, and including a sound board, a back plate, and a side wall extending between the sound board and the back plate, wherein the sound board includes lateral braces arranged in the interior and contacting an interior surface of the back plate;

a bridge plate arrange on an interior surface of the sound board; and slanted sound posts arranged in the interior, the slanted sound posts each defining a first end and a second end distal from the first end, the first end contacting the sound board and the side wall, and the second end contacting the back plate and one of the lateral braces.

2. The musical string instrument according to claim 1, wherein:

the lateral braces include a first lateral brace and a second lateral brace, the first lateral brace is arranged closest to the neck end, and the second lateral brace is arranged closest to the tail end, the slanted sound posts include a first slanted sound post, a second slanted sound post, a third slanted sound post, and a fourth slanted sound post, the first and second slanted sound posts each contact the first lateral brace, and the third and fourth slanted sound posts each contact the second lateral brace.

3. The musical string instrument according to claim 2, wherein:

the lateral braces further include a third lateral brace arranged between the first lateral brace and the second lateral brace, the slanted sound posts further include a fifth slanted sound post and a sixth slanted sound post, and the fifth and sixth slanted sound posts each contact the third lateral brace.

4. The musical string instrument according to claim 3, further including longitudinal braces arranged in the interior, and each contacting adjacent lateral braces, or one of the lateral braces and the side wall.

5. The musical string instrument according to claim 4, wherein:

the longitudinal braces include a first longitudinal brace, a second longitudinal brace, a third longitudinal brace, a fourth longitudinal brace, a fifth longitudinal brace, a sixth longitudinal brace, a seventh longitudinal brace, an eighth longitudinal brace, a ninth longitudinal brace, and a tenth longitudinal brace, the first and second longitudinal braces each contact a portion of the side wall at the neck end and the first lateral brace, the third and fourth longitudinal braces each contact a portion of the side wall at the tail end and the second lateral brace, the fifth and sixth longitudinal braces each contact the first lateral brace and the fourth lateral brace, the seventh and eighth longitudinal braces each contact the third lateral brace and the fourth lateral brace, and the ninth and tenth longitudinal braces each contact the second lateral brace and the third lateral brace.

6. The musical string instrument according to claim 1, further including:

a neck block arranged in the interior and contacting an interior surface of the side wall at the neck end, a tail block arranged in the interior and contacting a portion of the side wall at the tail end, longitudinal blocks arranged in the interior and on the back plate, and contacting two adjacent lateral braces, contacting one of the lateral braces and the neck block, or contacting one of the lateral braces and the tail block.

7. The musical string instrument according to claim 1, further including a flat metal sheet arranged in the interior, wherein a major surface of the flat metal sheet is mated to a flat interior surface of the bridge plate.

8. The musical string instrument according to claim 5, wherein:

the first, third, fifth, seven, and ninth longitudinal braces are arranged in a straight line extending in a longitudinal direction between the neck end and the tail end; and the second, fourth, sixth, eighth, and tenth longitudinal braces are arranged in a straight line extending in the longitudinal direction.

9. The musical string instrument according to claim 8, further including:

a neck block arranged in the interior and contacting an interior surface of the side wall at the neck end, a tail block arranged in the interior and contacting a portion of the side wall at the tail end, longitudinal blocks arranged in the interior and on the back plate, and contacting two adjacent lateral braces, contacting the first lateral brace and the neck block, or contacting the second lateral brace and the tail block.

10. The musical string instrument according to claim 9, further including a flat metal sheet arranged in the interior, wherein a surface of the flat metal sheet is mated to a flat interior surface of the bridge plate.

11. A method of enhancing sound produced by a musical string instrument, comprising:

providing a musical string instrument including:

a hollow body defining an interior, a tail end, and a neck end opposite from the tail end, and including a sound board, a back plate, and a side wall extending between the sound board and the back plate, the sound board including lateral braces arranged in the interior and contacting an interior surface of the back plate; and a bridge plate arrange on an interior surface of the sound board;

providing slanted sound posts, each defining a first end and a second end distal from the first end, arranging the slanted sound posts in the interior such that for each of the slanted sound posts, the first end contacts the sound board and the side wall, and the second end contacts the back plate and one of the lateral braces.

12. The method according to claim 11, wherein:

the lateral braces include a first lateral brace and a second lateral brace, the first lateral brace is arranged closest to the neck end, and the second lateral brace is arranged closest to the tail end, the slanted sound posts include a first slanted sound post, a second slanted sound post, a third slanted sound post, and a fourth slanted sound post, the first and second slanted sound posts each contact the first lateral brace, and the third and fourth slanted sound posts each contact the second lateral brace.

13. The method according to claim 12, wherein:

the lateral braces further include a third lateral brace arranged between the first lateral brace and the second lateral brace, the slanted sound posts further include a fifth slanted sound post and a sixth slanted sound post, and the fifth and sixth slanted sound posts each contact the third lateral brace.

14. The method according to claim 13, further comprising arranging longitudinal braces in the interior, such that the longitudinal braces each contact adjacent lateral braces, or one of the lateral braces and the side wall.

15. The method according to claim 14, wherein:

the longitudinal braces include a first longitudinal brace, a second longitudinal brace, a third longitudinal brace, a fourth longitudinal brace, a fifth longitudinal brace, a sixth longitudinal brace, a seventh longitudinal brace, an eighth longitudinal brace, a ninth longitudinal brace, and a tenth longitudinal brace, the first and second longitudinal braces each contact a portion of the side wall at the neck end and the first lateral brace, the third and fourth longitudinal braces each contact a portion of the side wall at the tail end and the second lateral brace, the fifth and sixth longitudinal braces each contact the first lateral brace and the fourth lateral brace, the seventh and eighth longitudinal braces each contact the third lateral brace and the fourth lateral brace, and the ninth and tenth longitudinal braces each contact the second lateral brace and the third lateral brace.

16. The method according to claim 11, wherein:

the musical string instrument further comprises:

a neck block arranged in the interior and contacting an interior surface of the side wall at the neck end, and a tail block arranged in the interior and contacting a portion of the side wall at the tail end; and the method further comprises arranging longitudinal blocks in the interior and on the back plate, such that two of the longitudinal blocks each contact two adjacent lateral braces, one of the longitudinal blocks contacts one of the lateral braces and the neck block, and another one of the longitudinal blocks contacts another one of the lateral braces and the tail block.

17. The method according to claim 11, further comprising arranging a flat metal sheet in the interior such that a major flat surface of the flat metal sheet is mated to a flat interior surface of the bridge plate.

18. The method according to claim 15, wherein:

the first, third, fifth, seven, and ninth are arranged in a straight line extending in a longitudinal direction between the neck end and the tail end, and the second, fourth, sixth, eighth, and tenth longitudinal braces are arranged in a straight line extending in the longitudinal direction.

19. The method according to claim 18, wherein:

the musical string instrument further comprises:

a neck block arranged in the interior and contacting an interior surface of the side wall at the neck end, and a tail block arranged in the interior and contacting a portion of the side wall at the tail end; and the method further comprises arranging longitudinal blocks in the interior and on the back plate, such that two of the longitudinal blocks each contact two adjacent lateral braces, one of the longitudinal blocks contacts the first lateral brace and the neck block, and another one of the longitudinal blocks contacts the second lateral brace and the tail block.

20. The method according to claim 19, further comprising arranging a flat metal sheet in the interior such that a major surface of the flat metal sheet is mated to a flat interior surface of the bridge plate.

* * * * *